US007182079B2

(12) United States Patent
McPherson

(10) Patent No.: US 7,182,079 B2
(45) Date of Patent: Feb. 27, 2007

(54) BOWSTRING SERVING

(76) Inventor: Mathew A. McPherson, 19055 Incline Rd., Route 2, P.O. Box 58, Norwalk, WI (US) 54648

( * ) Notice: Subject to any disclaimer, the term of this patent is extended or adjusted under 35 U.S.C. 154(b) by 75 days.

(21) Appl. No.: 11/064,492

(22) Filed: Feb. 23, 2005

(65) Prior Publication Data

US 2006/0185659 A1 Aug. 24, 2006

(51) Int. Cl.
*F41B 5/00* (2006.01)

(52) U.S. Cl. ..... 124/90

(58) Field of Classification Search ..... 124/90, 124/91, 92

See application file for complete search history.

(56) References Cited

U.S. PATENT DOCUMENTS

| | | | | |
|---|---|---|---|---|
| 2,931,366 | A * | 4/1960 | Siegel | 131/245 |
| 2,981,053 | A * | 4/1961 | Steele | 57/21 |
| 3,328,059 | A * | 6/1967 | Geny | 289/1.2 |
| 3,444,853 | A * | 5/1969 | Hofmeister | 124/90 |
| 4,114,360 | A * | 9/1978 | Emmons | 57/202 |
| 4,957,094 | A | 9/1990 | Pickering et al. | 124/24.1 |
| 5,538,197 | A | 7/1996 | Killian | 242/439.3 |
| 5,715,804 | A | 2/1998 | Izuta | 124/90 |
| 5,884,617 | A | 3/1999 | Nelson | 124/90 |
| 6,253,754 | B1 | 7/2001 | Ward | 124/90 |
| 6,651,643 | B2 | 11/2003 | Simonds | 124/90 |
| 6,712,060 | B2 | 3/2004 | Egusquiza | 124/91 |

OTHER PUBLICATIONS

"Making a Bow String," 1991, Archer's Digest, 5th Edition, Chapter 4, pp. 74-81, DBI Books.

* cited by examiner

*Primary Examiner*—John A. Ricci
(74) *Attorney, Agent, or Firm*—Vidas, Arrett & Steinkraus, P.A.

(57) ABSTRACT

A bowstring for use in combination with an archery bow, the bowstring including a plurality of strands and a serving material wrapped around the plurality of strands, the serving material having a first end, a second end and a middle portion extending therebetween, the first end and the second end of the serving material inserted between said strands of the bowstring and the middle portion of the serving material wrapped over the at least the first such that the serving material is self-secured to the bowstring and a method of making the same.

9 Claims, 4 Drawing Sheets

BOWSTRING SERVING

FIELD OF THE INVENTION

The present invention relates to archery and bow hunting equipment, particularly to bowstring construction, specifically to the center serving application on the bowstring.

BACKGROUND OF THE INVENTION

It is a recognized practice to apply serving line to an archery bowstring. The center serving on the bowstring is intended to protect the bowstring in the area that it is applied from premature wear and abrasion due to the nocking and losing of the arrow.

Typically, a bowstring is assembled from multiple strands and displayed in position for applying serving line to the nock and loop end areas. Such a procedure is described in "Making A Bow String" Archer's Digest, 5th Edition, 1991, DBI Books. The procedure is time consuming, inefficient and inaccurate.

Bowstrings are generally made using one of two basic methods. One method consists of laying out multiple strands of a given length of a bowstring material and then dividing that material at the ends into two or more equal bundles and twisting or braiding these bundles into one single string or rope-like structure. The rope-like structure is then brought back on itself and is braided or twisted back into the original material to form an end loop.

A second method may be referred to in the art as an endless string. Using this method, a continuous strand of bowstring material is wrapped around two posts spaced apart at a distance which is approximately equal to that desired for the final bowstring length. The string is wrapped around the two posts until the desired number of strands is reached. The starting and ending point of the string is then tied together forming a splice. A separate piece of bowstring material is then typically wrapped or served over the area of the splice and end loops are formed by folding the served area back on itself and continuing to serve or wrap over the two sides of the string resulting in one multi-stranded bowstring with a loop at each end. The bowstrings thus made are usually held at one end while the other end is rotated to add twists to the main body of the string to bring the overall string length to a desired dimension that will result in the proper functioning of the bow on which the string is to be used. A bowstring so constructed is functional and can be used to launch arrows but unless one also wraps or serves the central portion of the string that comes in contact with the arrow the string will have a much shorter useful life expectancy than desired. Therefore it is desirable to also serve or wrap the bowstring in the area that comes in contact with the arrow and the means of losing the arrow. In almost all cases the bowstrings are served or wrapped in this area and it is referred to as the center serving. The center serving's purpose is to protect the central area of the bowstring from the wear that results from the attachment of the arrow and the means used to loose the arrow at launch.

FIGS. 1–4 illustrate a prior art center serving wherein a center serving is applied over a multiple strand bowstring body. A serving tool is typically employed for this purpose. A serving tool is described, for example, in U.S. Pat. No. 5,538,197, the entire content of which is incorporated by reference herein. To begin the wrapping process, approximately one foot of serving material 8 is pulled from the serving tool (not shown). The end 10 of the serving material 8 is held while the opposite end 12 of the serving material 8 which is attached to the serving tool (not shown) is wrapped around bowstring 20 twice as represented at 14 in FIG. 1. The loose end 10 of the serving is then laid back over the bowstring 20 as shown in FIG. 2.

In FIG. 3, end 12 attached to serving tool is then wrapped over the laid back end 10 in a continuous spiral fashion represented at 16 thereby encapsulating the bundled bowstring 20. Generally one wants to apply this serving as tight as possible with the idea that it will remain in position when finished. To finish off the central serving one can lay a loop 22 of serving material parallel to the bowstring with the loop 22 pointing in the direction of the end of the serving and extending beyond where the serving is to end as shown in FIG. 4. The serving material is then wrapped over loop 22 as well as shown at reference numeral 18 in FIG. 4. When the desired length of serving is obtained, end 12 of serving material is fed back through the loop 22 and with end 12 held tightly, loop ends 31, 32 are pulled tight resulting in the loop 22 to be drawn under the serving material. End 12 of serving material exits from serving at 19, and is pulled as tightly as possible and any excess material is removed.

The above methods required that the serving material be applied very tightly so that it will maintain its position during use. Some manufacturers have taken extra precautions to limit serving movement during use by applying the serving over a bowstring which is treated in the serving area with an adhesive or have applied materials over the serving in an attempt to hold the serving in position and to keep it from separating. These additional steps both add to the cost of manufacturing and increase the amount of clean-up time because of adhesive residue.

Over the useful life of the bowstring it is often necessary to add twists to the bowstring to compensate for the natural elongation of the bowstring material. The additional twists added to the bowstring can decrease the diameter of the bowstring resulting in loosening of the center serving.

Thus, while it has long been the practice to serve or wrap the bowstring in this central area it has also been a problem to keep that center serving tight and properly located in the central section of the bowstring.

The present invention provides an improved method of wrapping the central portion of the bowstring such that it is tight and remains properly positioned over time even if additional twists are added to the bowstring.

SUMMARY OF THE INVENTION

The present invention relates to a novel bowstring construction, particularly the center serving portion of the bowstring.

The present invention results in the application of a center serving that is not only tight but is also locked into the main body of the bowstring in a manner that keeps it properly located and does not allow the serving to migrate up or down the bowstring in use.

In the present invention the serving is locked positively to the bowstring both at the beginning and end of the serving, which keeps the serving from migrating up or down the bowstring in use and should the bow string elongate over its useful life and need to be twisted to bring it back into length such action will actually tend to further tighten the central serving making it even less susceptible to movement.

Other aspects of the invention are described in the Detailed Description and in the claims below.

DETAILED DESCRIPTION OF THE INVENTION

While this invention may be embodied in many different forms, there are described in detail herein specific embodiments of the invention. This description is an exemplification of the principles of the invention and is not intended to limit the invention to the particular embodiments illustrated.

All published documents, including all US patent documents, mentioned anywhere in this application are hereby expressly incorporated herein by reference in their entirety. Any copending patent applications, mentioned anywhere in this application are also hereby expressly incorporated herein by reference in their entirety.

The serving and process of forming the serving described herein, may be employed for either endless or Flemish style bowstrings.

FIGS. 5–10 illustrate a process of applying a center serving to a bowstring according to the invention.

Figure 1:
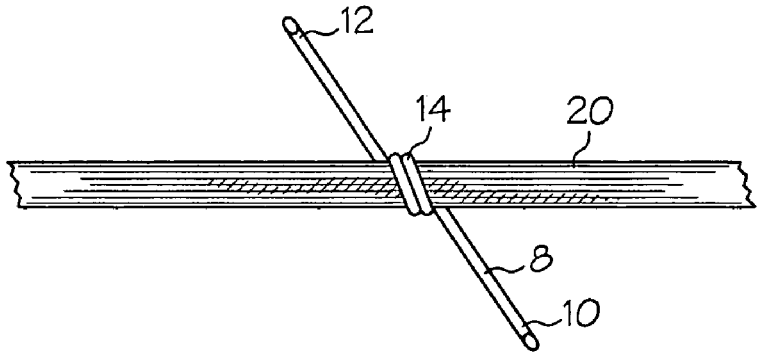
FIG. 1 (PRIOR ART)
FIGS. 1–4 illustrate a prior art process of applying a center serving to a bowstring.
Figure 2:
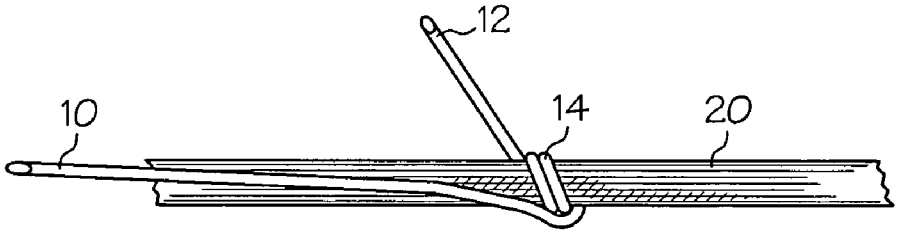
FIG. 2 (PRIOR ART)
Figure 3:
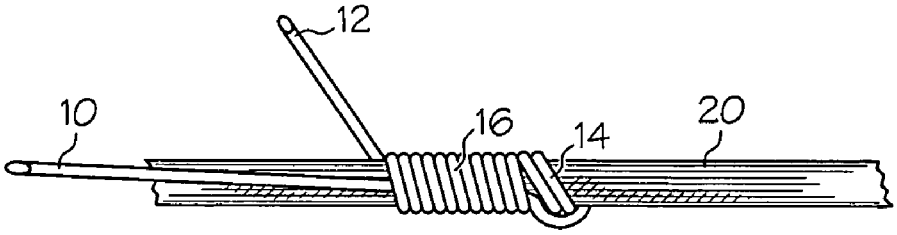
FIG. 3 (PRIOR ART)
Figure 4:
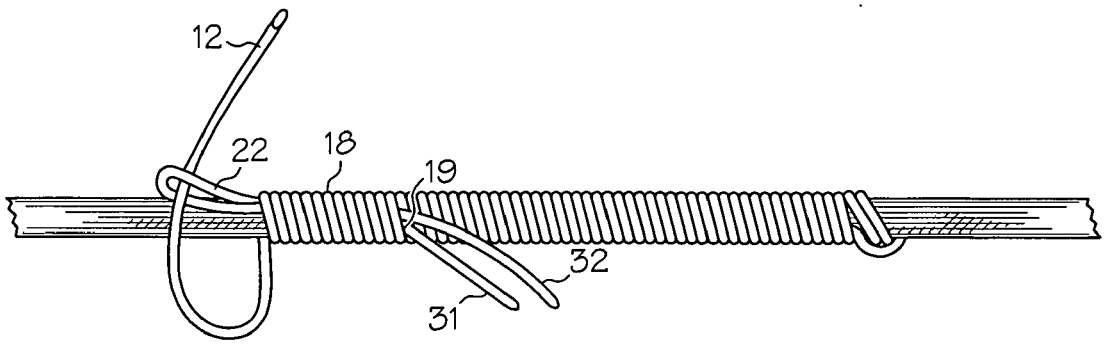
FIG. 4 (PRIOR ART)
Figure 5:
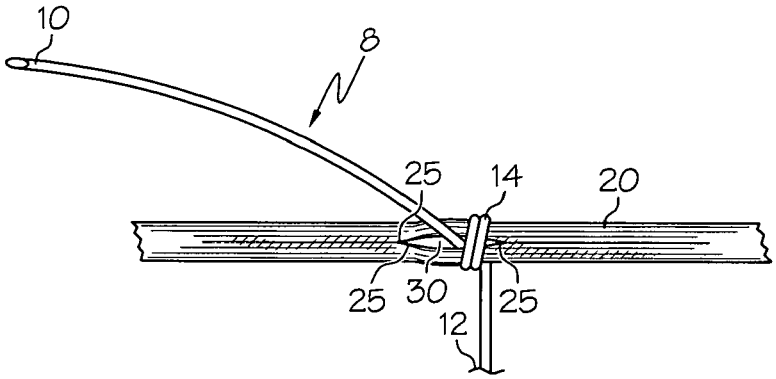
FIGS. 5–10 illustrate a process of applying a center serving to a bowstring according to the invention.

FIG. 5 is a partial longitudinal side view of a bowstring which has been laid up and the looped ends formed (not shown). The bowstring is typically held under some degree of tension using any means known in the art such as two posts or hooks spaced at the desirable distance apart in order to bring each of the individual strands which form the bowstring under adequate tension. The bowstring may or may not be twisted at this time but in most cases there will probably be some number of twists in the bowstring. The number of twists is suitably less at this time than the number required to bring the string into proper finished length. The process described herein, is directed to a bowstring that either is or will be twisted in the clockwise direction to bring the bowstring to its final desired length. The present invention is not, however, limited to bowstrings twisted in a clockwise direction.

As shown in FIG. 5, individual strands 25 of bowstring 20 are separated, desirably at the center of bowstring 20, to form an opening 30. Desirably, an equal number of strands 25 are located on either side of opening 30. End 10 of serving material 8 is inserted through opening 30 such that it protrudes to a desirable length, for example about 12–14 inches through the opening 30 of the bowstring 20.

End 12 of serving material 8 is held in serving tool (not shown) while loose end 10 of serving material 8 is held to the left of the serving tool. Two wraps around the bowstring in a counterclockwise direction represented at 14 are then made using serving tool (not shown).

Figure 6:
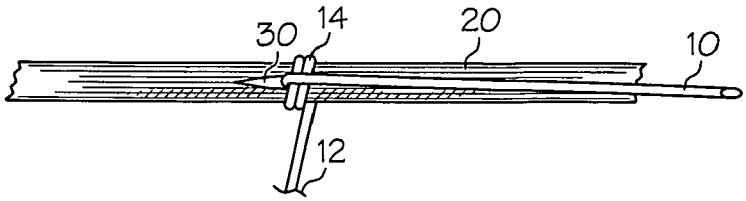
Figure 7:
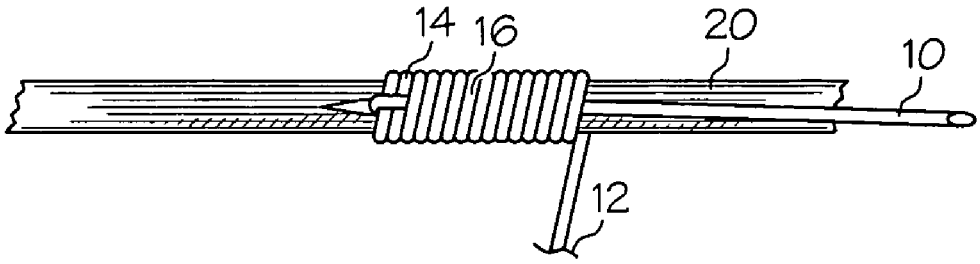

The loose end 10 of the serving material 8 is then brought back across the dual wraps 14 to the right side of wraps 14 as shown in FIG. 6. Of course, all of the steps may be done in the opposite direction as well. The serving material 8 is then wrapped counterclockwise around bowstring 20 approximately 10 more times as shown in FIG. 7. As can be seen in FIG. 7, the serving material 8 is also wrapped over the end 10 of serving material 8 such that serving material 8 is being wrapped over itself. Also, the number of wraps of serving material around the bowstring may be varied.

The remainder of the serving material can be secured to the bowstring by using two half hitches at a position which is about 6–12, suitably 8 inches to the right of the serving (not shown). The bowstring is served in the counterclockwise direction until the desired length of serving is obtained. The loose end of the serving can then be cut near the present serving position and covered by several more wraps of serving. Three is a suitable number but this may be varied depending on the length of the loose end which is being wrapped.

Figure 8:
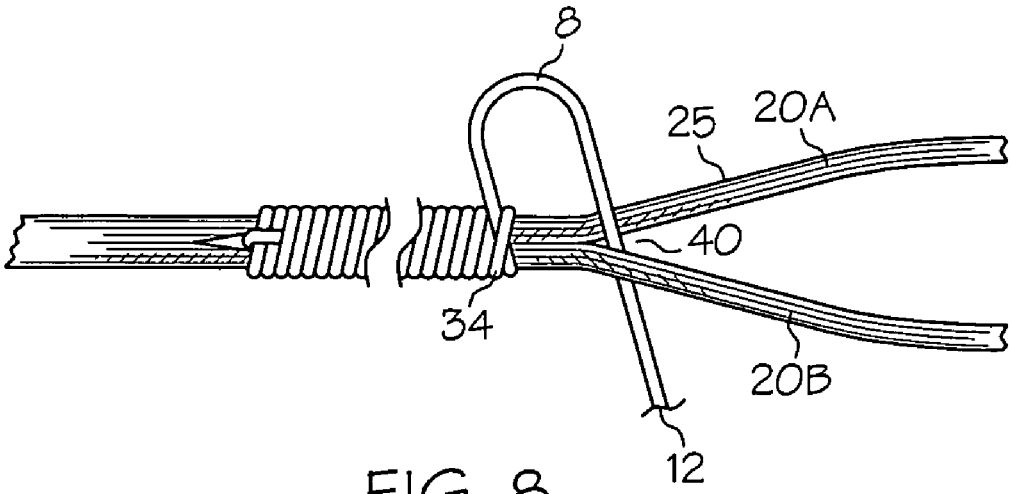

Approximately 6–12 inches, suitably about 8 inches, of serving material can then be pulled from the serving tool at end 12. A half hitch knot 34 may be tied around the bowstring as shown in FIG. 8 adjacent the previous wraps. This knot may be loosely cinched at this time.

The individual bowstring strands 25 may again be separated into two bundles 20*a* and 20*b*. Suitably, bundle 20*a* has an equal number of strands to bundle 20*b*. The end 12 of serving material 8 and serving tool (not shown) can then be placed through the opening 40 formed between bundles 20*a* and 20*b*. It may be necessary to temporarily relieve pressure on the bowstring at this point such that the bundles may be separated. The serving material is then again cinched next to the previously made half hitch represented by reference numeral 42 in FIG. 9.

Approximately 1–6 inches from the previous serving, suitably about 4 inches from the previous counterclockwise serving, a second serving may be started, this time in a clockwise direction. Shown in FIG. 9, approximately 10 backwraps 32 have been created in a clockwise direction.

Figure 9:
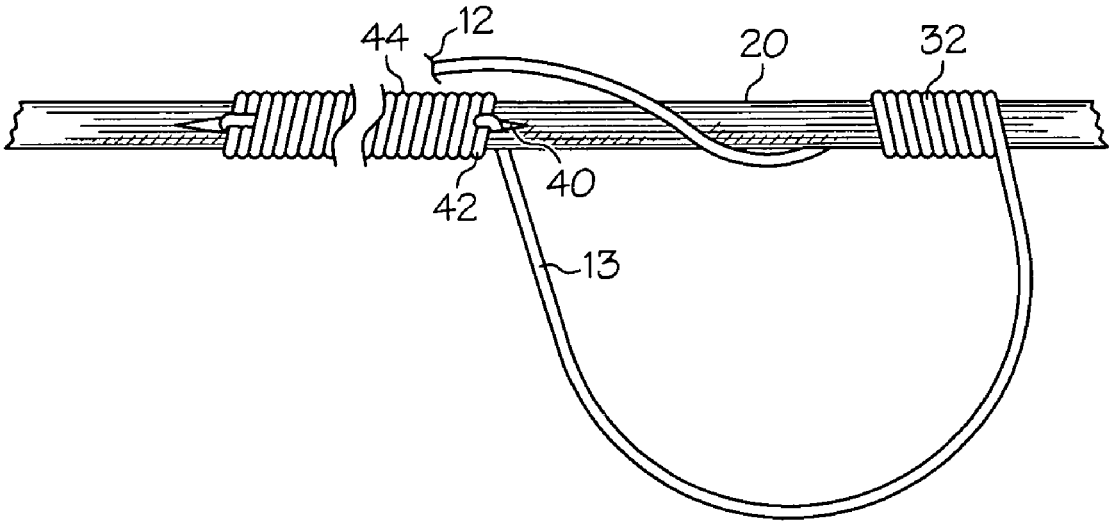
Figure 10:
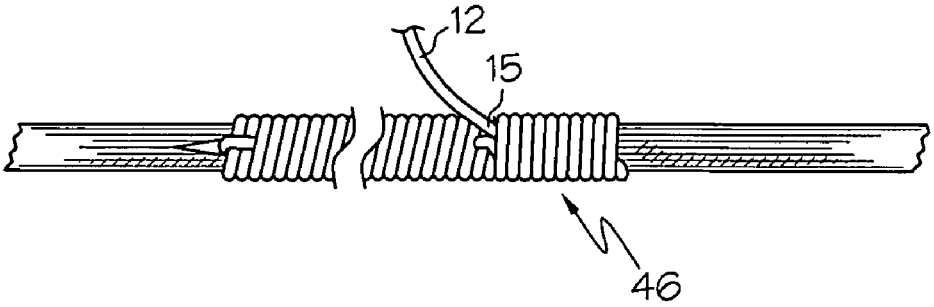

End portion 12 of serving material is then held over the served portion 44 of the bowstring 20 shown in FIG. 9. The serving material 13 which is protruding through opening 40 is then wrapped in a counterclockwise direction as shown at 46 in FIG. 10 until all of the backwraps are consumed. Using the serving tool (not shown), the end 12 of the serving material is then pulled tight and trimmed 15 close to the serving.

The entire process may be reversed for a bowstring which is to be twisted in the counterclockwise direction.

Use of this process tends to result in tightening of the string serving when additional twists are added to the bowstring.

The above disclosure is intended to be illustrative and not exhaustive. This description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

The invention claimed is:

1. A bowstring comprising;

a) a plurality of strands; and b) a serving material wrapped around said plurality of strands, said serving material having a first end, a second end and a middle portion extending therebetween, the first end and the second end of said serving material inserted between said strands of said bowstring and said middle portion of said serving material wrapped over at least the first end of the serving material such that said serving material is self-secured to said bowstring.

2. The bowstring of claim 1 wherein said middle portion of said serving material is wrapped over said first end and said second end of said serving material.

3. The bowstring of claim 1 wherein said plurality of strands is formed using a single continuous strand.

4. The bowstring of claim 1 wherein said serving material is a monofilament fiber.

5. The bowstring of claim 1 wherein said serving material is a multifilament fiber.

6. The bowstring of claim 1 wherein said serving material is in the form of a thin flat ribbon.

7. The bowstring of claim 1 wherein said bowstring is twisted in a clockwise direction and said serving material is wrapped in a counterclockwise direction.

8. The bowstring of claim 1 wherein said bowstring is twisted in a counterclockwise direction and said serving material is wrapped in a clockwise direction.

9. The bowstring of claim 1 in combination with an archery bow.

* * * * *